US008869659B2

(12) United States Patent
Chang

(10) Patent No.: US 8,869,659 B2
(45) Date of Patent: Oct. 28, 2014

(54) HAND TOOL

(71) Applicant: Man-Chi Chang, Taichung (TW)

(72) Inventor: Man-Chi Chang, Taichung (TW)

( * ) Notice: Subject to any disclaimer, the term of this patent is extended or adjusted under 35 U.S.C. 154(b) by 245 days.

(21) Appl. No.: 13/633,875

(22) Filed: Oct. 3, 2012

(65) Prior Publication Data

US 2014/0090524 A1 Apr. 3, 2014

(51) Int. Cl.
*B25B 23/16* (2006.01)
*B25G 1/00* (2006.01)

(52) U.S. Cl.
USPC ..... 81/177.85; 81/177.1

(58) Field of Classification Search
USPC ..... 81/177.1, 177.2, 177.5, 177.85
See application file for complete search history.

(56) References Cited

U.S. PATENT DOCUMENTS

| | | | | |
|---|---|---|---|---|
| 6,089,133 | A * | 7/2000 | Liao | 81/438 |
| 7,013,765 | B2 * | 3/2006 | Chang | 81/177.2 |
| 7,387,053 | B2 * | 6/2008 | Lee | 81/177.1 |
| 7,878,094 | B2 * | 2/2011 | Lin | 81/177.2 |
| 7,905,163 | B1 * | 3/2011 | Chiang | 81/177.9 |
| 7,997,169 | B1 * | 8/2011 | Hack | 81/177.2 |
| 8,505,418 | B1 * | 8/2013 | Chiang | 81/177.2 |
| 2013/0068072 | A1 * | 3/2013 | Li et al. | 81/177.2 |
| 2013/0255449 | A1 * | 10/2013 | Chang | 81/177.1 |
| 2014/0090520 | A1 * | 4/2014 | Lee | 81/177.1 |

* cited by examiner

*Primary Examiner* — David B Thomas

(57) ABSTRACT

A hand tool includes a shank, a sleeve, a control member, a pressing member, an end piece and a resilient member. The shank has multiple annular grooves. The control member and the resilient member are located in the chamber of the sleeve and the end piece closes the sleeve. The shank extends through the control member and the end piece. When the pressing member is not applied by a force, the sleeve can only rotate relative to the shank and cannot move relative to the shank. When the sleeve is applied by a force, the sleeve can move relative to the shank.

8 Claims, 8 Drawing Sheets

HAND TOOL

FIELD OF THE INVENTION

The present invention relates to a hand tool, and more particularly, to a hand tool having a sleeve mounted thereto and the hand is able to be rotated 360 degrees.

BACKGROUND OF THE INVENTION

The conventional hand tool 90 is disclosed in FIG. 11 and is a T-shaped tool, a screw bit is connected to the function end 91 of the hand tool 90 and the user holds the transverse bar to rotate the screw bit to tighten or loosen the screw (not shown). However, it is experienced that it is not convenient for the user to rotate the hand tool 360 degrees.

The present invention intends to provide a hand tool which can be easily rotated 360 degrees to tighten or loosen the object.

SUMMARY OF THE INVENTION

The present invention relates to a hand tool and comprises a shank, a sleeve, a control member, a pressing member, an end piece and a resilient member. The shank has multiple annular grooves. The control member and the resilient member are located in the chamber of the sleeve and the end piece closes the sleeve. The shank extends through the control member and the end piece. When the pressing member is not applied by a force, the sleeve can only rotate relative to the shank and cannot move relative to the shank. When the sleeve is applied by a force, the sleeve can move relative to the shank.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
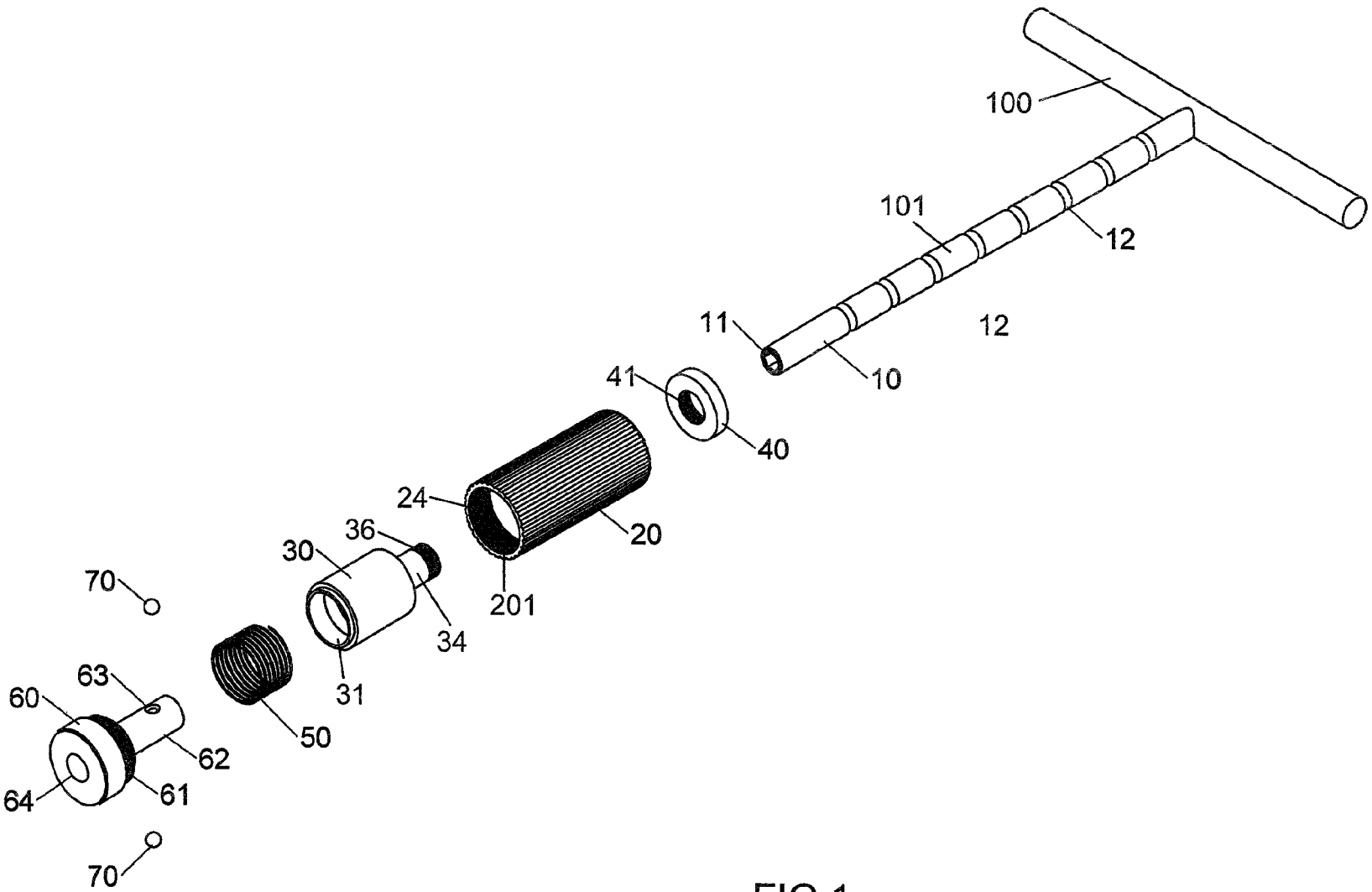
FIG. 1 is an exploded view to show the hand tool of the present invention.
Figure 3:
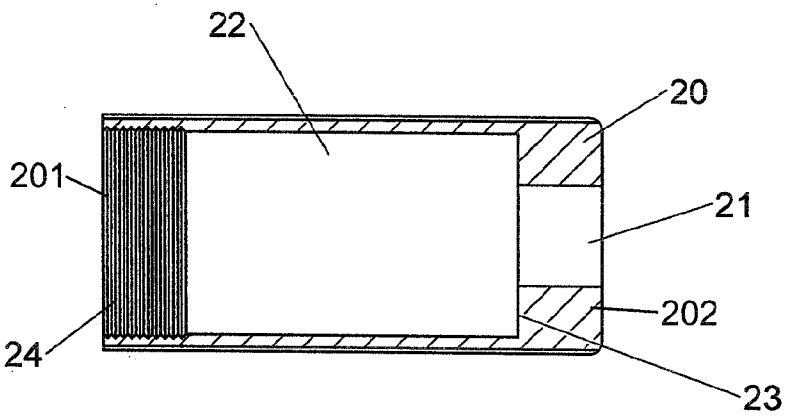
FIG. 3 is a cross sectional view taken along ling A-A in FIG. 2.
Figure 2:
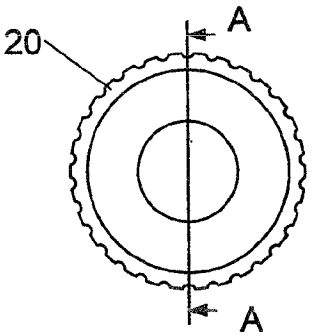
FIG. 2 is an end view of the hand tool of the present invention.
Figure 4:
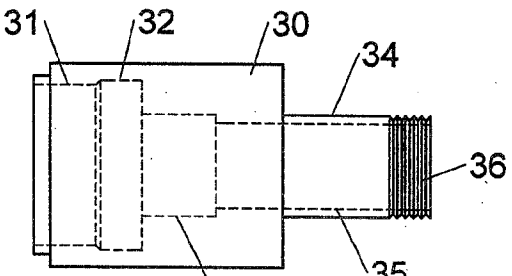
FIG. 4 is a side view of the hand tool of the present invention.

Referring to FIGS. 1 to 4, the hand toll 10 of the present invention comprises a straight shank 101, a sleeve 20, a control member 30, a pressing member 40, a resilient member 50, an end piece 50 and a bead 70. The shank 101 has a mounting portion 11 defined in the first end thereof and multiple annular grooves 12 are defined in the outer periphery of the shank 101. The second end of the shank 101 is connected to the medial portion of a transverse bar 100 so as to form a T-shaped tool. In this embodiment, the mounting portion 11 is a hexagonal recess so as to be connected with a screw bit (not shown).

The sleeve 20 has a chamber 22 defined therein, an opening 201 and a through hole 21 are respectively defined two ends of the sleeve 20. The opening 201 and the through hole 21 communicate with the chamber 22. The through hole 21 is defined by an annular wall 202 extending inward and radially from the inner periphery of the sleeve 20, and a contact shoulder 23 is formed at the conjunction portion between the annular wall 202 and the inner periphery of the chamber 22. A first connection portion 24, inner threads in this embodiment, is defined in the inner periphery of the opening 201.

The cylindrical control member 30 is located in the chamber 22 and has a first cylindrical space 31, a second cylindrical space 32 and a third cylindrical space 33 defined in sequence in the inner periphery of the control member 30. The first, second and third cylindrical spaces 31, 32, 33 communicate with each other. The diameter of the second cylindrical space 32 is larger than that of the first cylindrical space 31. The diameter of the third cylindrical space 33 is smaller than that of the first cylindrical space 31. A first tubular portion 34 extends from one end of the control member 30. The outer diameter of the first tubular portion 34 is smaller than that of the control member 30. The first tubular portion 34 rotatably extends through the through hole 21 and the distal end of the first tubular portion 34 extends beyond the sleeve 20. The first tubular portion 34 has a fourth cylindrical space 35 defined therein, and the third cylindrical space 33 communicates with the fourth cylindrical space 35 in the first tubular portion 34. The diameter of the fourth cylindrical space 35 is smaller than that of the third cylindrical space 33. The shank 101 extends through the first tubular portion 34 and a second connection portion 36, outer threads in this embodiment, is defined in the outer periphery of the distal end of the first tubular portion 34.

The pressing member 40 is a ring and has a third connection portion 41 defined in the inner periphery thereof. The third connection portion 41 includes inner threads in this embodiment. The pressing member 40 is pressed by the user when operating the hand tool. The pressing member 40 is connected to the second connection portion 36 by the third connection portion 41. A gap is defined between the pressing member 40 and the sleeve 20.

The resilient member 50, a spring in this embodiment, is located in the chamber 22 and the first end of the resilient member 50 biases against the control member 30 which contacts the contact shoulder 23. The first tubular portion 34 extends through the sleeve 20 via the through hole 21.

The end piece 60 has a fourth connection portion 61 defined in the outer periphery of the mediate portion thereof. In this embodiment, the fourth connection portion 61 includes outer threads. The fourth connection portion 61 is connected with the first connection portion 24 to connect the end piece 60 to the sleeve 20. The end piece 60 has a second tubular portion 62 extending from one end thereof and the outer diameter of the second tubular portion 62 is smaller than that of the end piece 60. The second tubular portion 62 rotatably extends through the third cylindrical space 33. At least one tapered recess 63 is defined through the wall of the second tubular portion 62. The end piece 60 has a fifth cylindrical space 64 defined therethrough through which the shank 101 extends. The at least one tapered recess 63 communicates with the fifth cylindrical space 64. The second end of the resilient member 50 biases against the end piece 60. In other words, the resilient member 50 is biased between the control member 30 and the end piece 60. The smallest diameter of the recess 32 is smaller than the diameter of the bead 70 which is located between the control member 30 and the second tubular portion 62.

Figure 5:
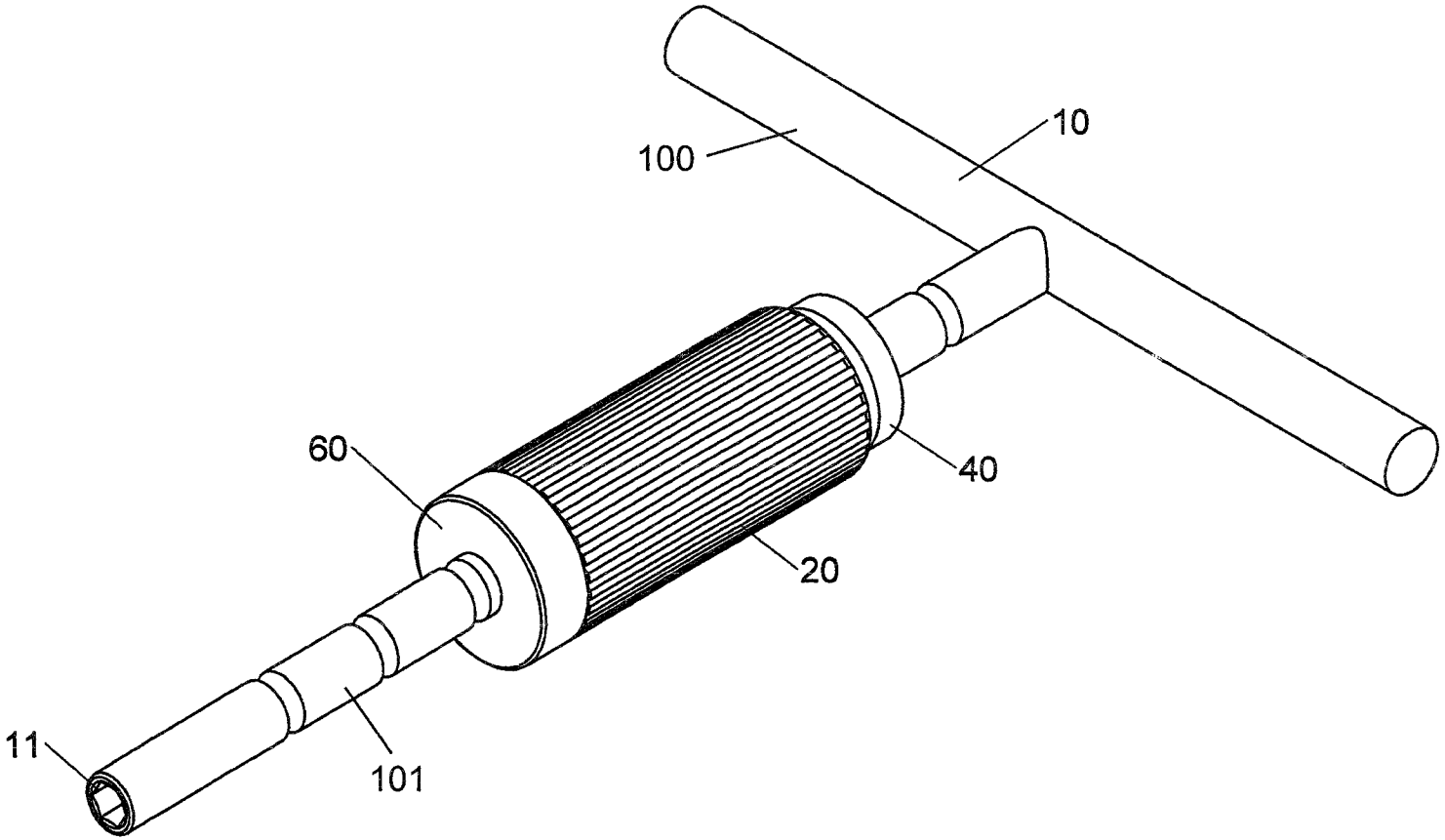
FIG. 5 is a perspective view to show the hand tool of the present invention.
Figure 7:
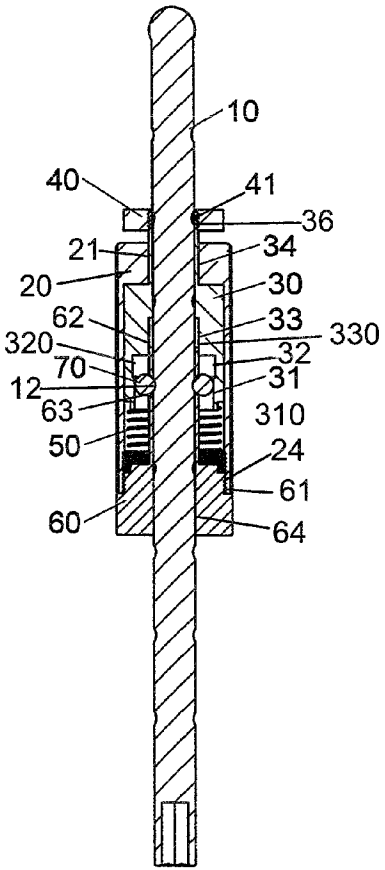
FIG. 7 is a cross sectional view taken along ling B-B in FIG. 5.
Figure 6:
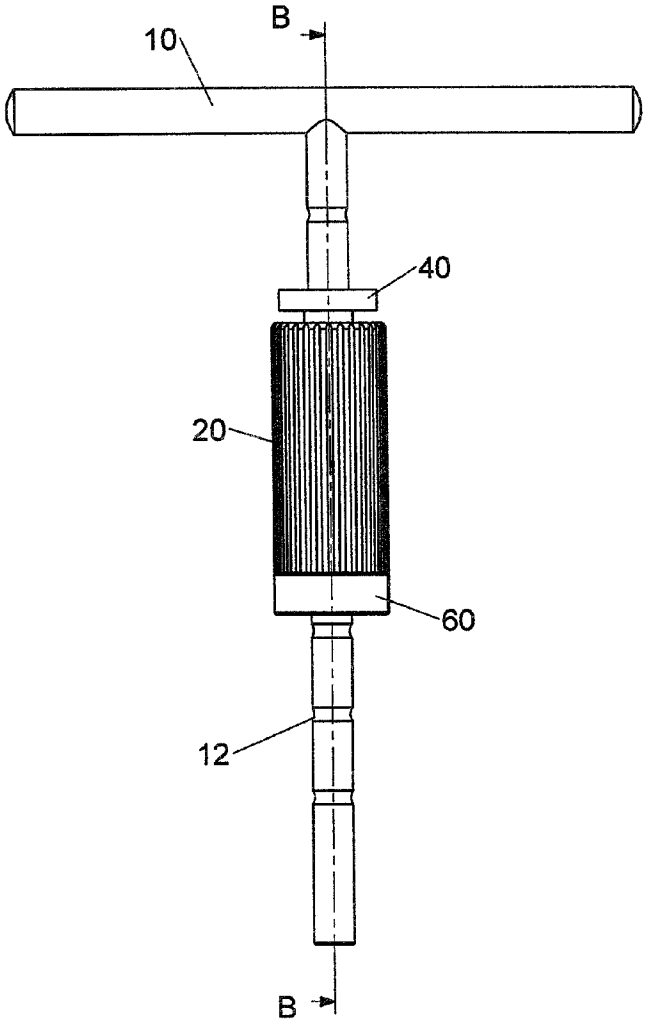
FIG. 6 is a top view of the hand tool of the present invention.
Figure 8:
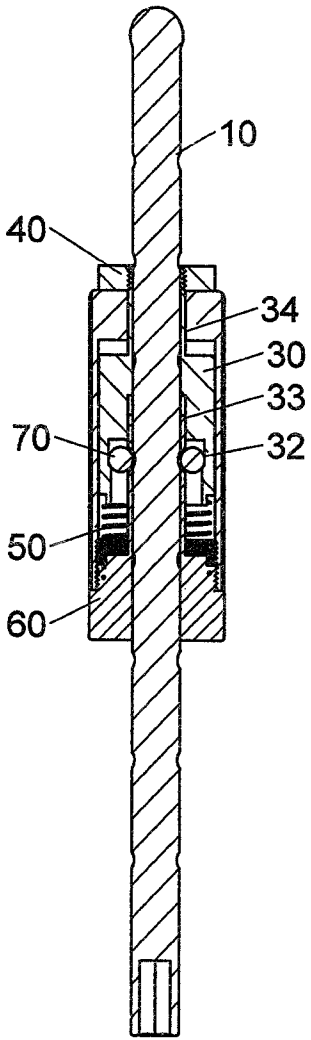
FIG. 8 is a cross sectional view to show that the sleeve is moved relative to the shank of the hand tool of the present invention.

As shown in FIGS. 5 to 7, the control member 30 is biased by the resilient member 50 and the bead 70 contacts the inner peripheral wall of the first cylindrical space 31, the bead 70 is located in the recess 62 of the end piece 60. The bead 70 also is engaged with one of the annular grooves 12 to secure the shank 101 relative to the control member 30 and the sleeve 20. In other words, the shank 101 cannot move within the fourth cylindrical space 35 of the control member 30. The sleeve 20 can only rotate relative to the shank 101 and cannot move relative to the shank 101. As shown in FIG. 8, when the user presses the pressing member 40, the control member 30 moves relative to the sleeve 20, and the bead 70 moves to the second cylindrical space 32 and pushed by the inner peripheral wall of the second cylindrical space 32. The sleeve 20 is able to move relative to the shank 101.

Figure 9:
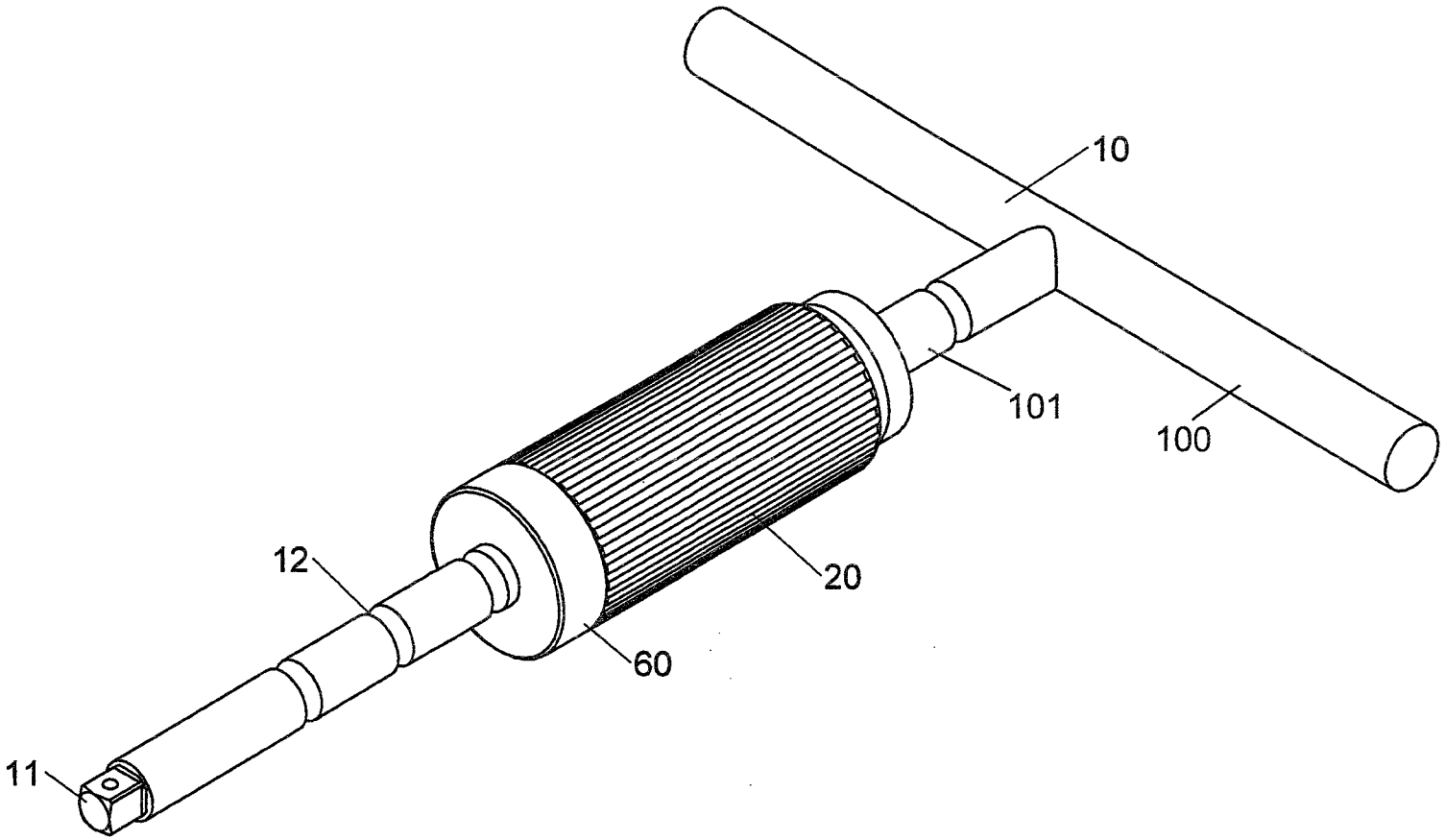
FIG. 9 is a perspective view to show the second embodiment of the hand tool of the present invention.

As shown in FIG. 9, the mounting portion 11 of the second embodiment of the hand tool 10 of the present invention is a rectangular recess.

Figure 10:
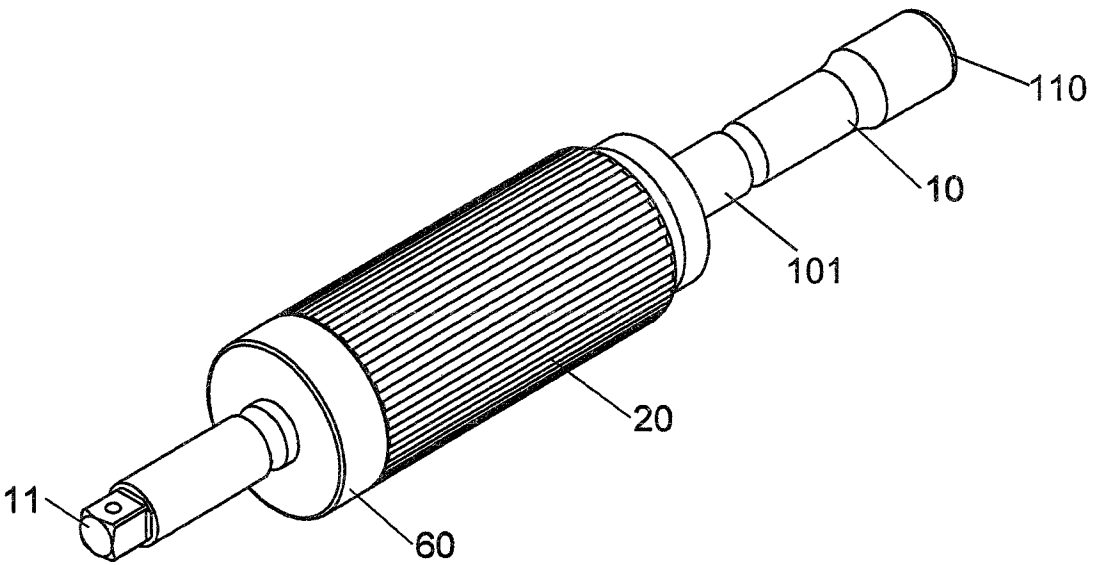
FIG. 10 is a perspective view to show the third embodiment of the hand tool of the present invention.
Figure 11:
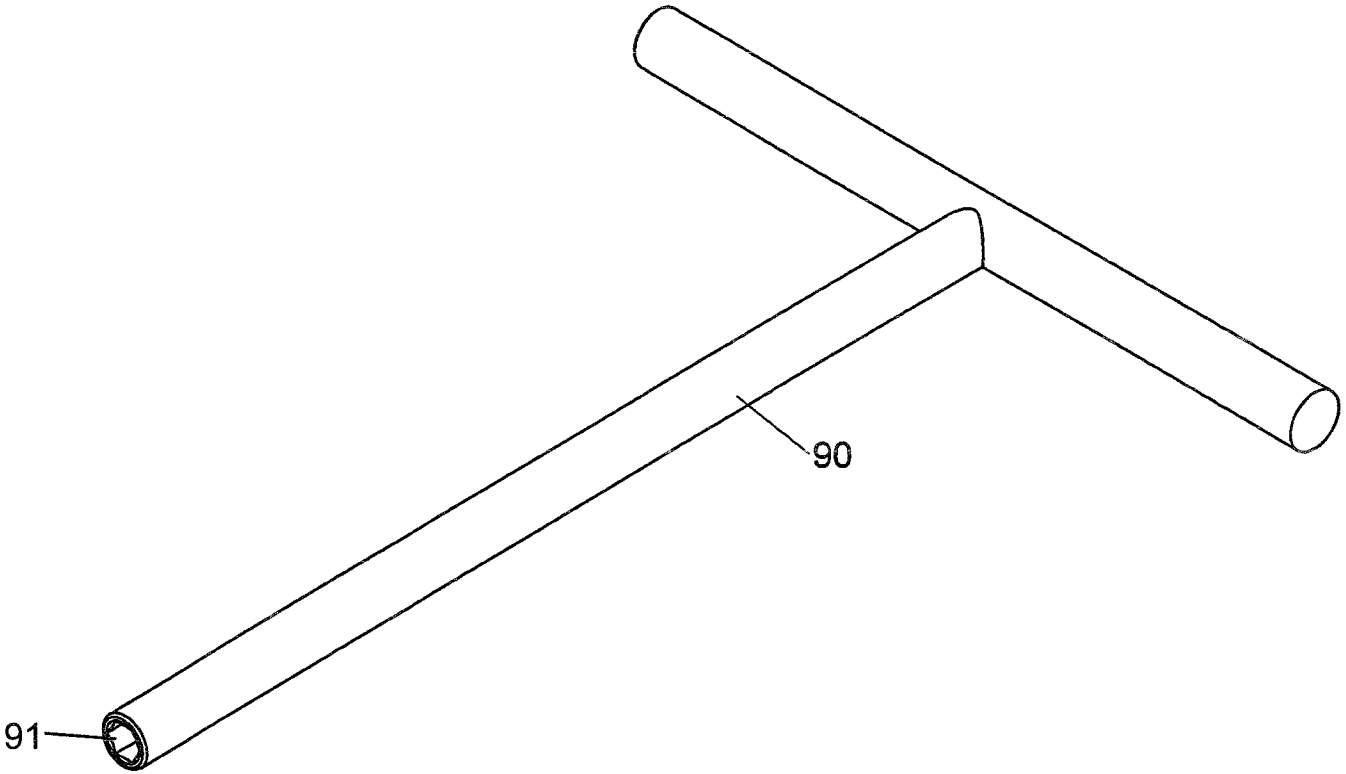
PRIOR ART FIG. 11
FIG. 11 is a perspective view to show the conventional hand tool.

FIG. 10 shows the third embodiment of the hand tool 10 of the present invention wherein the shank 101 has two mounting portions 11, 110 respectively defined in the first and second ends thereof. The two mounting portions 11, 110 have different shapes.

The advantages of the present invention are that the bead 70 is pushed by the inner peripheral wall of the first cylindrical space 31 so that the bead 70 is engaged with one of the annular grooves 12. The sleeve 20 and the control member 30 can only rotate relative to the shank 101.

When pressing the pressing member 40, the bead 70 is received in the annular groove 12 and the sleeve 20 and the control member 30 can move relative to the shank 101.

When in use, the user holds the sleeve 20 and the shank 101 can be rotated 360 degrees to quickly drive the object to be loosened or tightened. The user's hand does not contact the shank 101.

While we have shown and described the embodiment in accordance with the present invention, it should be clear to those skilled in the art that further embodiments may be made without departing from the scope of the present invention.

What is claimed is:

1. A hand tool comprising:

a straight shank having a mounting portion defined in a first end thereof and multiple annular grooves defined in an outer periphery of the shank;

a sleeve having a chamber defined therein, an opening and a through hole respectively defined two ends of the sleeve and communicating with the chamber, the through hole being defined by an annular wall extending inward and radially from an inner periphery of the sleeve, a contact shoulder being formed at a conjunction portion between the annular wall and an inner periphery of the chamber, a first connection portion defined in an inner periphery of the opening;

a control member located in the chamber and having a first cylindrical space, a second cylindrical space and a third cylindrical space defined in an inner periphery of the control member, the first, second and third cylindrical spaces communicating with each other, a diameter of the second cylindrical space being larger than that of the first cylindrical space, a diameter of the third cylindrical space being smaller than that of the first cylindrical space, a first tubular portion extending from an end of the control member, a diameter of the first tubular portion being smaller than that of the control member, the first tubular portion rotatably extending through the through hole and having a fourth cylindrical space defined therein, the third cylindrical space communicating with the fourth cylindrical space in the first tubular portion, a diameter of the fourth cylindrical space being smaller than that of the third cylindrical space, the shank extending through the first tubular portion and a second connection portion defined in an outer periphery of a distal end of the first tubular portion;

a pressing member being a ring and having a third connection portion defined in an inner periphery thereof, the pressing member connected to the second connection portion by the third connection portion, a gap defined between the pressing member and the sleeve;

a resilient member located in the chamber and a first end of the resilient member biased against the control member which contacts the contact shoulder, the first tubular portion extending through the sleeve via the through hole;

an end piece having a fourth connection portion defined in an outer periphery of a mediate portion thereof, the fourth connection portion connected with the first connection portion to connect the end piece to the sleeve, the end piece having a second tubular portion extending from an end thereof and an outer diameter of the second tubular portion being smaller than that of the end piece, the second tubular portion rotatably extending through the third cylindrical space, at least one tapered recess defined through a wall of the second tubular portion, the end piece having a fifth cylindrical space defined therethrough through which the shank extends, the at least one tapered recess communicating with the fifth cylindrical space, a second end of the resilient member biased against the end piece, and at least one bead engaged with the at least one recess;

when the control member is biased by the resilient member, the at least one bead contacts an inner peripheral wall of the first cylindrical space 31 and engaged with one of the annular grooves, the sleeve is rotatable relative to the shank and cannot move relative to the shank, when the control member is moved relative to the sleeve, the at least one bead contacts against an inner peripheral wall of the second cylindrical space and is removed from the annular groove, the sleeve is movable relative to the shank.

2. The hand tool as claimed in claim 1, wherein a second end of the shank is connected to a medial portion of a transverse bar.

3. The hand tool as claimed in claim 1, wherein the mounting portion is a hexagonal recess.

4. The hand tool as claimed in claim 1, wherein the mounting portion is a rectangular recess.

5. The hand tool as claimed in claim 1, wherein the shank has two mounting portions respectively defined in the first end and a second end thereof.

6. The hand tool as claimed in claim 1, wherein the first connection portion includes inner threads and the second connection portion includes outer threads, the third connection portion includes inner threads and the fourth portion includes outer threads.

7. The hand tool as claimed in claim 1, wherein the resilient member is a spring.

8. The hand tool as claimed in claim 1, wherein the at least one recess includes two recesses which are located corresponding to each other, each recess has one bead received therein.

* * * * *